United States Patent [19]

Cullis

[11] 4,120,448

[45] Oct. 17, 1978

[54] CENTRIFUGAL LIQUID PROCESSING APPARATUS WITH AUTOMATICALLY POSITIONED COLLECTION PORT

[75] Inventor: Herbert M. Cullis, Silver Spring, Md.

[73] Assignee: Baxter Travenol Laboratories, Inc., Deerfield, Ill.

[21] Appl. No.: 804,697

[22] Filed: Jun. 8, 1977

[51] Int. Cl.[2] ..... B04B 11/06

[52] U.S. Cl. ..... 233/22; 233/46

[58] Field of Search ..... 233/46, 47 R, 27, 28, 233/22, 21, 20 R, 19 R, 1 R, 26

[56] References Cited

U.S. PATENT DOCUMENTS

| | | | |
|---|---|---|---|
| 3,623,658 | 11/1971 | Garbaty | 233/20 R |
| 3,672,564 | 6/1972 | Schlutz et al. | 233/26 |
| 3,749,304 | 7/1973 | Putterlik | 233/47 R |
| 3,791,576 | 2/1974 | Bazil | 233/19 R |
| 4,058,252 | 11/1977 | Williams | 233/26 |

*Primary Examiner*—George H. Krizmanich

*Attorney, Agent, or Firm*—Henry W. Collins; Richard G. Kinney; Eugene M. Cummings

[57] ABSTRACT

An intervivos blood processor includes a processing chamber wherein whole blood is separated into its red blood cell, white blood cell and plasma components in the presence of a centrifugal force field. The white blood cell component is removed from the chamber by means of a tubing segment having a free floating end within the chamber and a density corresponding to the density of the white blood cell component. Since the free end of the tubing assumes the same position in the chamber as the white blood cell component the tubing collects only this component notwithstanding variations in the flow rate of the blood through the chamber and the centifugal force field applied to the chamber.

12 Claims, 7 Drawing Figures

CENTRIFUGAL LIQUID PROCESSING APPARATUS WITH AUTOMATICALLY POSITIONED COLLECTION PORT

BACKGROUND OF THE INVENTION

The present invention is directed generally to the centrifugal treatment of liquids, and more particularly to apparatus for centrifugally treating liquid by separating it into fractions of different densities. The invention has particular application to the fractionation of whole blood and the present disclosure is directed primarily to this application. However, it will be understood that the apparatus of the present invention is applicable to the treatment of other liquids and semi-liquid masses as well.

Intervivos blood processing, wherein blood is taken from a live donor, passed through centrifugal processing apparatus, and then returned to the donor, has come into wide use during recent years. During passage through the centrifugal processing apparatus the blood is separated or fractionated into its component parts, i.e., plasma, red blood cells (RBC's), and white blood cells (WBC's) or platelets, and some portion of these fractions may be returned to the donor while other portions may be selectively retained within suitable storage means.

Apparatus for the intervivos processing of blood typically consists of a chamber of relatively small interior volume through which the whole blood from the donor is caused to flow while under the force of centrifugation. Because of their difference in densities the blood components congregate in zones of different radial distances from the center of rotation of the separation chamber. Collection ports in the chamber then remove the components for storage or recirculation.

The centrifugal processing chamber may be constructed in various forms, such as the bowl-shape contemplated in U.S. Pat. Nos. 3,489,145 and 3,655,123, or the annular diamond shaped cross-section form illustrated herein. In either case, the object is to provide a chamber wherein the red blood cell component, which has the highest specific gravity, can congregate during centrifugation at one radial extreme of the chamber, and the plasma component, which has the lowest specific gravity, can congregate at the other radial extreme of the chamber. Between these extremes a collection point is provided for the white blood cell component, which has a specific gravity between the red blood cell and plasma components.

One problem heretofore encountered with intervivos centrifugal liquid processing apparatus has been the necessity of having to accurately control flow rates and collection rates in the processing chamber so as to maintain the white blood cell component within the central portion of the chamber wherein it can be collected by the appropriate collection port. Typically, this has required that the process be continuously monitored, either by a technician or by a suitable electro-optical system, to assure that the separated components are being collected in their respective zones. Any failure in this respect can result in the collected components being rendered unusable.

The present invention is directed to a centrifugal liquid processing apparatus which is less critical to variations in flow rates and therefore provides more consistent collection of a desired fraction such as white blood cell components even under varying flow conditions.

Accordingly, it is a general object of the present invention to provide a new and improved centrifugal liquid processing apparatus.

It is another object of the present invention to provide a new and improved centrifugal liquid processing apparatus wherein a desired fractional component is derived with improved consistency.

It is another object of the present invention to provide a new and improved centrifugal liquid processing apparatus which is less susceptible to variations in flow rates.

It is another object of the present invention to provide new and improved apparatus for the intervivos separation of whole blood into its constituent components.

SUMMARY OF THE INVENTION

The invention is directed to a centrifugal processor for use in conjunction with centrifugation apparatus including drive means for separating a selected fractional component from a whole fluid. The processor includes a housing carried on the drive means and defining a centrifugal processing chamber inlet means including an inlet port for supplying the whole fluid to be processed to the separation chamber, the selected fraction congregating within the chamber in a collection zone upon centrifugation of the chamber, and collection means including a free-floating collection port disposed within the chamber and floating within the separation zone during rotation of the chamber for removing the selected fraction therefrom.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
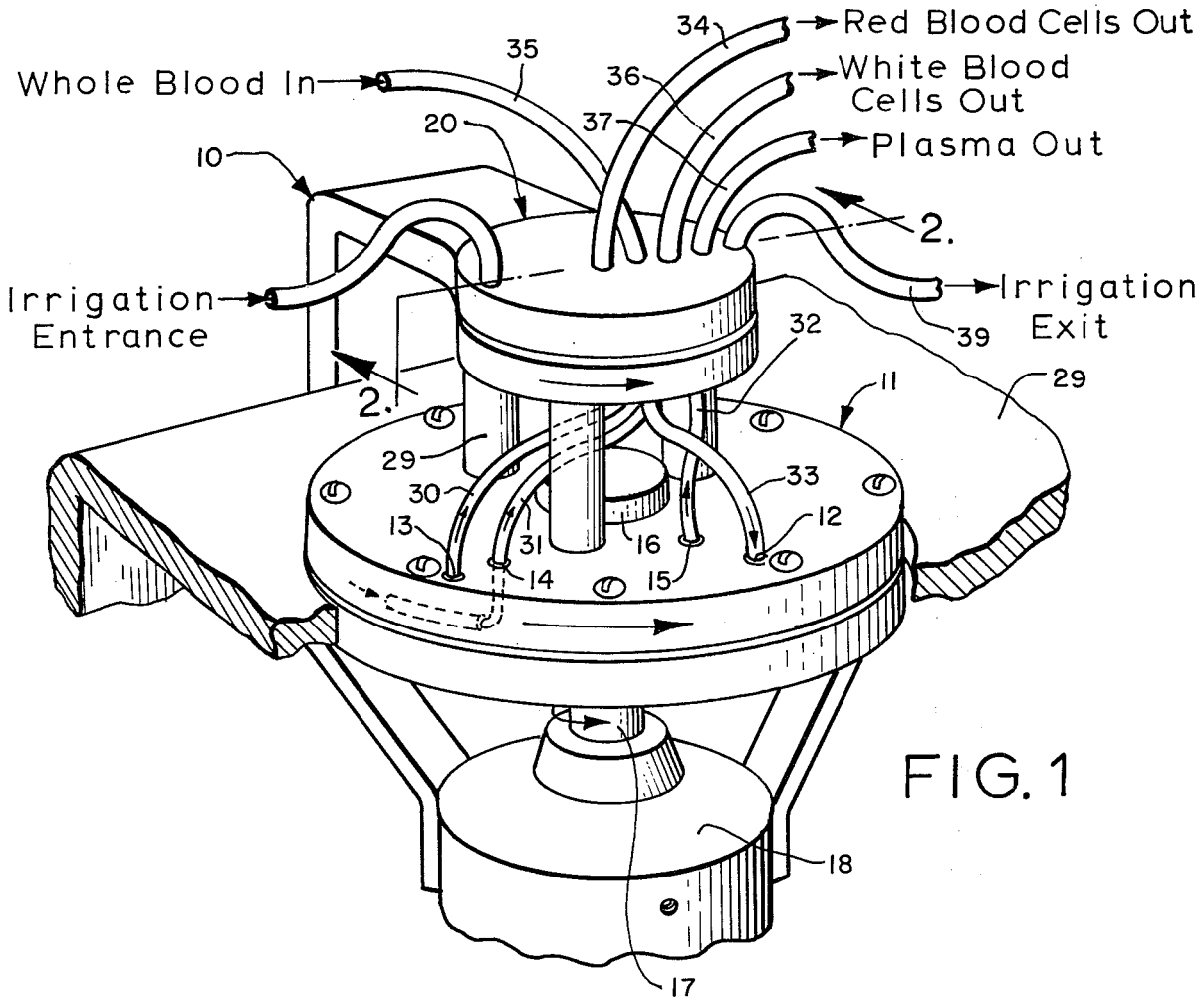
FIG. 1 is a perspective view of a centrifugal blood separator constructed in accordance with the invention partially broken away to show the principal components thereof.
Figure 2:
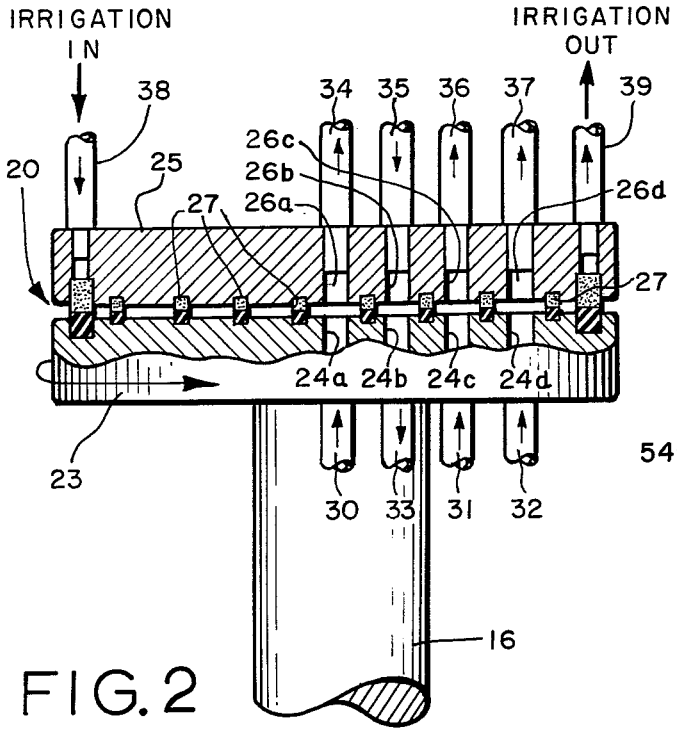
FIG. 2 is an enlarged cross-sectional view of the rotating seal assembly utilized in the apparatus shown in FIG. 1.

Referring to the Figures, and particularly to FIG. 1, a centrifugal blood separator 10 constructed in accordance with the invention includes a generally disc-shaped centrifugal liquid processor unit 11 within which fractionation of whole blood takes place. The centrifugal processor unit 11 includes four whole blood inlet ports 12 equally spaced about a first circumference on the top surface of the unit, four red blood cell (RBC) collection ports 13 equally spaced between the inlet ports, two white blood cell (WBC) collection ports 14 equally spaced about a second circumference of lesser diameter than the first circumferences, and four plasma collection ports 15 equally spaced about a fourth circumference of lesser diameter than the first, second and third circumferences.

The centrifugal processor unit 11 is seated on a rotatably driven hub 16 which is coupled to the drive shaft 17 of an electric motor 18. Upon operation of electric motor 18 the processor unit 11 is caused to rotate with hub 16 to subject whole blood contained therein to a centrifugal force field in a manner well known to the art.

To provide fluid communication between the inlet port and the three collection ports and the non-rotating portions of the flow system associated with separator 10 a rotating seal assembly 20 is provided along the axis of rotation of processor 11. This seal assembly, which may be conventional in construction and operation, consists of a rotating member 23 having a plurality of ring-shaped recesses **24*a*–24*d* therein and a stationary member 25 having a plurality of communicating ring-shaped recesses 26*a*–26*d* therein. Individual lands 27** are provided between respective ones of the recesses to maintain fluid isolation and additional recesses and lands may be provided in conjunction with irrigation and/or lubrication flow systems for improved operation of the rotating seal in a manner well known to the art.

Outlet ports 13–15 are connected to recesses **24*a*, 24*c* and 24*d*, respectively, in the rotating seal assembly 20 by means of respective lengths of tubing 30, 31 and 32. Similarly, recess 24*b* is connected by a length of tubing 33 to inlet port 12 to provide a fluid path for whole blood entering the processor 11. In practice, the four collection ports associated with each fractional component are connected by means of appropriate Y-connectors and appropriate lengths of connecting tubing to their respective ring-shaped recess in rotating seal assembly 20. These connections are shown in FIG. 1** for the sake of clarity.

The upper non-rotating portion 25 of the rotating seal assembly 20 is held in a stationary non-rotating position in compressive-engagement with the lower rotating portion 23 by means of a retaining arm 28 mounted on the frame 29 of the centrifugation apparatus. The lower rotating portion 23 of the seal may consist of a polished ceramic disc attached to the top surface of processor 11 by means of three spacers 29, and the upper stationary portion of the seal may be formed of stainless steel having a lapped surface for sealing engagement with the ceramic disc. Each of the ring-shaped recesses **26*a*–26*d* thereon is connected by a respective one of tubing segments 34–37** to an associated flow system (not shown), which in the case of an intervivos blood processing application, is well known to the art.

Specifically, the RBC outlet ports are connected to a first peristaltic pump, the WBC outlet ports are connected to a second peristaltic pump, and the plasma outlet ports are connected to a third peristaltic pump. The three pumps pump the separated white blood cell, red blood cell and plasma components derived by the system to respective collection bags for storage, or to the donor, as required. Whole blood is drawn into the system as a result of a suction created by the withdrawal of the white blood cell, red blood cell, and plasma components by the respective pumps. Acidic citrate dextrose (ACD) is added to the pumped into whole blood. Saline is supplied to the rotating seal assembly 20 for lubrication and isolation purposes through a tubing segment 38 and exhausted through a tubing segment 39. Various safety devices may be incorporated into the system to guard against the leakage of air, or an undue rise in temperature, or the occlusion of a vein in the donor.

Figure 3:
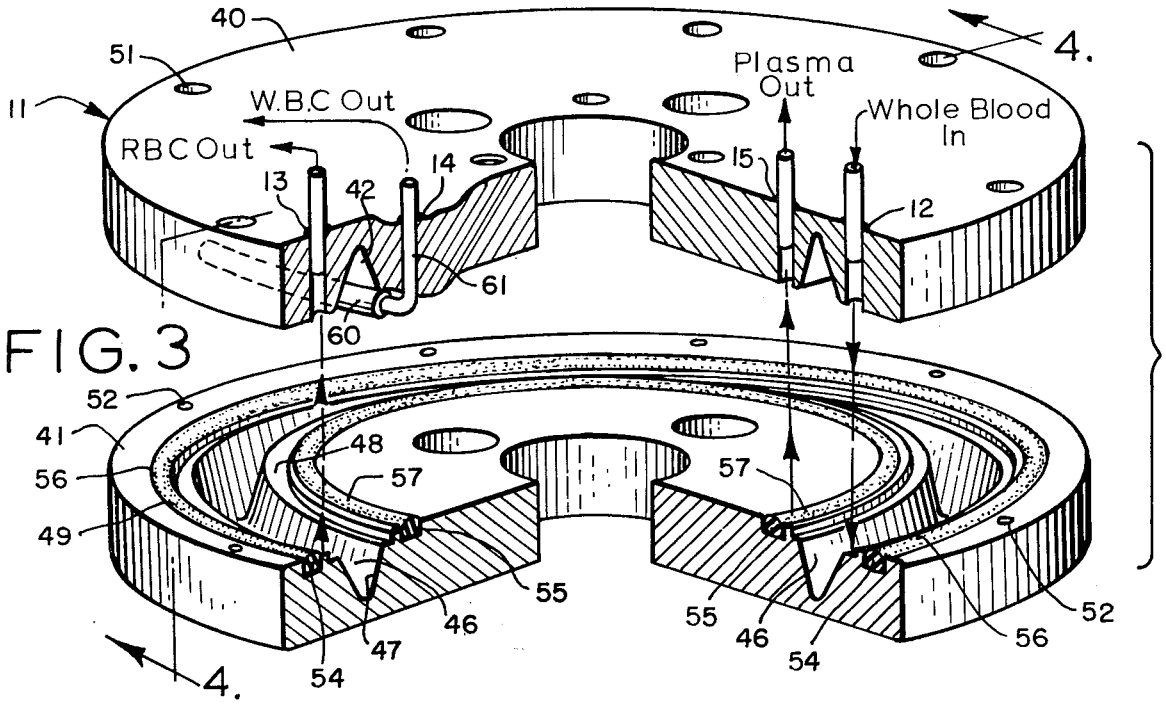
FIG. 3 is an enlarged exploded perspective view partially in cross-section of the housing sections forming the centrifugal blood separator shown in FIG. 1.
Figure 4:
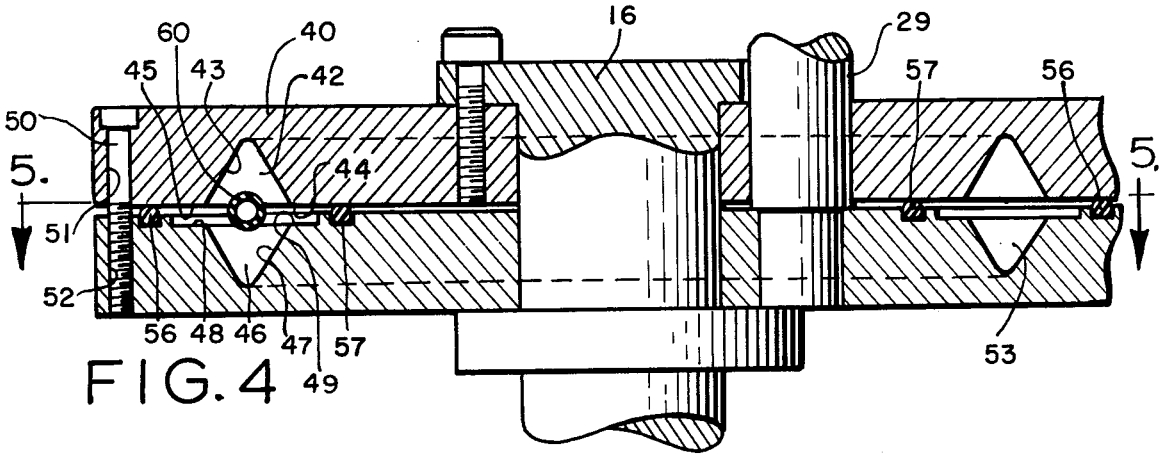
FIG. 4 is an enlarged cross-sectional view of the blood separator taken along line 4—4 of FIG. 3 showing the housing sections of FIG. 3 in an assembled state.
Figure 5:
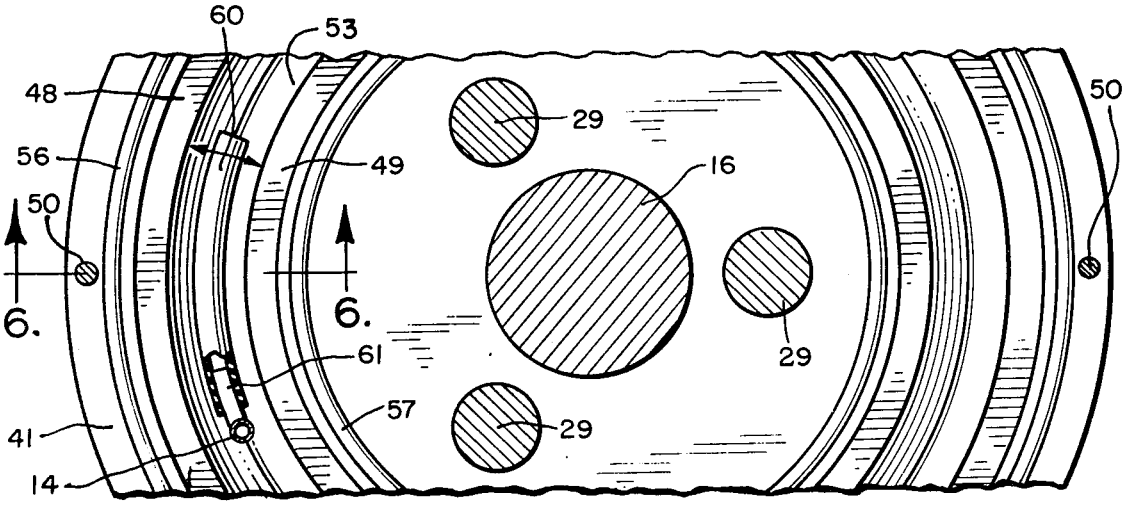
FIG. 5 is a cross-sectional view of the blood separator taken along line 5—5 of FIG. 4.

Referring to FIGS. 3–5, the centrifugal liquid processor 11 is seen to comprise upper and lower disc-shaped housing sections 40 and 41. The upper housing section 40 includes on its inside surface a generally annular recess 42. This recess consists of a central generally V-shaped portion 43 (FIG. 4) which communicates at its inside extreme with an annular inner rim portion 44, and at its outside extreme with an outside rim portion 45. Similarly, the bottom housing section 41 includes on its inside face a recess 46 consisting of a central generally annular V-shaped portion 47, which communicates at its inner extreme with an annular inner ledge 48, and at its outer extreme with a annular outer ledge 49.

The red blood cell (RBC) collection ports 13 extend through the upper disc-shaped housing section 40 and into communication with the outer rim portion 44 of recess 42. Similarly, the plasma collection ports 15 extend through the upper housing section and into communication with the inner ledge portion 45 of recess 42. The whole blood inlet port 12 also communicates with the inner ledge portion but at locations circumferentially spaced from the red blood cell collection ports.

Figure 6:
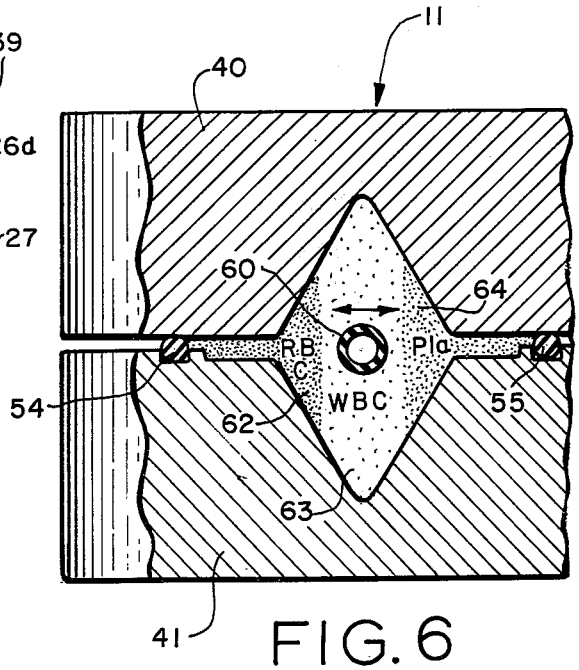
FIG. 6 is an enlarged cross-sectional view of the blood separator taken along line 6—6 of FIG. 5.

The upper and lower container sections 40 and 41 are held in tight engagement by means of a plurality of machine screws 50 which extend through apertures 51 in the upper section and into threaded engagement with apertures 52 in the lower section. When so joined the upper and lower housing sections cooperate to form an internal centrifugal liquid processing chamber 53 having a generally diamond-shaped cross-section as shown in FIGS. 4 and 6. To maintain a tight liquid seal for chamber 53 the bottom housing section 41 includes first and second annular channels 54 and 55 adjacent the inner and outer extremes of 46. First and second O-rings 46 and 57 are seated in these channels so as to form, in a manner well known to the art, a seal with the inside surface of housing section 40 as that element is brought into compression with housing section 41. This is best illustrated in FIG. 4, wherein the housing sections are shown in engagement.

It will also be noted that the centrifugal liquid processor 11 is rotationally coupled to hub 15 by means of additional machine screws 58 which extend through a flange on the hub and into threaded bores 59 appropriately located on the upper housing section 40.

In operation, the centrifugal processor 11 is rotated at approximately 800 rpm to establish a centrifugal force field across processing chamber 53. The flow path is next primed with sterile saline solution and all air bubbles are removed by back-flushing the system through the peristaltic pump associated with the white blood cell collection port. Whole blood is then admitted through tubing 35, rotating seal assembly 20, and tubing segment 33 into inlet port 12. After entering centrifugal processing chamber 53, the whole blood flows radially outwardly under the influence of the centrifugal force field. The centrifuge speed is now adjusted to achieve separation of the red blood cell, white blood cell and plasma components.

As illustrated in FIG. 6 the whole blood eventually separates within processing chamber 53 into three concentric zones or bands 62–64, with the dense red blood cells in the outermost band, the platelets or plasma in the innermost band, and the white blood cells, or buffy coat, in the center band. Collection ports 13, 14 and 15 remove these components from processing chamber 53 for collection or return to the donor as desired.

The red blood cells, which congregate in the outermost zone 62 are withdrawn through collection port 13 by means of the peristaltic pump associated with this port. The less dense plasma component, which congregates in the innermost zone 64, is withdrawn through collection port 15 by means of the peristaltic pump associated with that port. The white blood cell component, being of lesser density or specific gravity than the red blood cell component, and of greater density or specific gravity than the plasma component, congregates in zone 63 intermediate zones 62 and 64. The exact location of the zones, and hence the boundaries between the three blood components, is dependent on both the flow rate through processing chamber 53 and the speed of rotation of the processing compartment 11.

In prior art centrifugal blood processing apparatus a fixed aperture was provided in the upper housing section which extended into zone 63 to withdraw the white blood cell component. Unfortunately, with variations in flow rate and rotational speed the port provided for collecting this component could be maintained in communication with the white blood cell zone only with some difficulty.

In accordance with the invention, a selected fractional component of the whole blood, in this case the white blood cell component, is derived from chamber 53 by collection means in the form of a pair of flexible collection tube sections or pick-offs 60. These collection tubes, which are best shown in FIG. 5, extend generally along the center of chamber 53 and each circumscribe a portion of the circumference of the chamber, typically in the order of 45°–90°. The tubing sections 60 at one end are unattached and free floating, and at their other end are attached to L-shaped rigid tube segments 61 (FIG. 3) which extend first circumferentially and then in an axial direction with respect to the housing sections to form the white blood cell collection ports 14. Thus, the free end of tubing segment 60 is free to move in either a radial or axial direction, as shown in FIG. 5.

To enable the collection tubes to automatically compensate for flow rate and rotational speed variations, the specific gravity of the tubing segments is arranged to be substantially equal to that of the component being derived, in this case the white blood cell component. As a result, the free end of the tubing segment automatically seeks a position within chamber 53 within the zone occupied by the white blood cell component, since the tubing segment and the blood component are acted upon by the centrifugal force field to the same degree and therefore seek the same position with respect to the axis of rotation of the chamber. Since collection is accomplished through the free floating end, the desired component is automatically selected and withdrawn from the processing chamber.

The upper and lower housing sections 40 and 41 of processor unit 11 are preferably molded of a polycarbonate plastic such as Lexan (a trademark of General Plastic Corporation) by means of conventional molding techniques. In a representative application, the processor unit 11 is formed with an outside diameter of approximately 6 inches and a height of approximately 2 inches.

Figure 7:
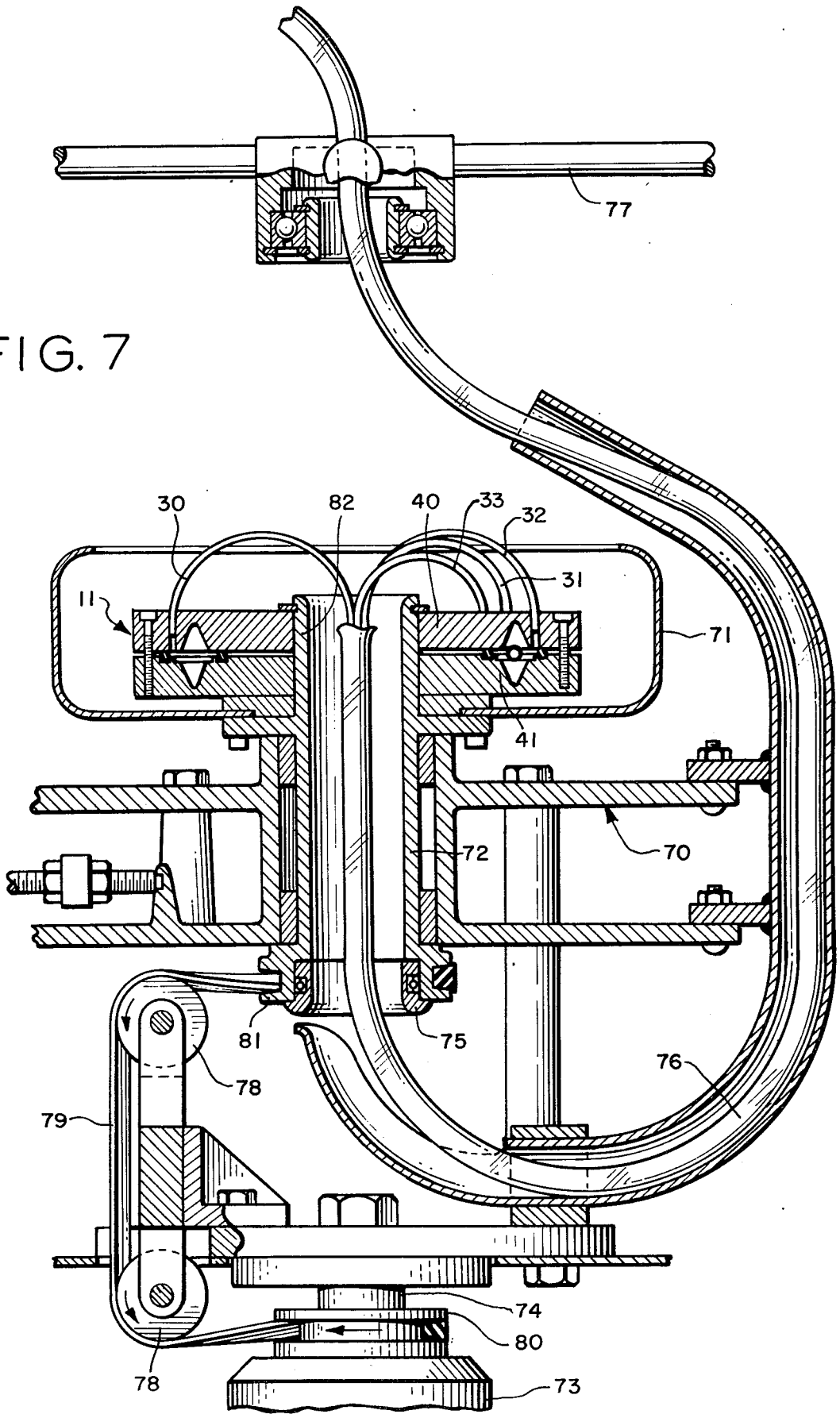
FIG. 7 is an enlarged side elevational view partially in cross-section showing the blood separator in conjunction with a seal-less centrifugation apparatus.

Referring to FIG. 7, the centrifugal processor unit 11 may also be utilized in conjunction with a seal-less centrifugation apparatus such as that described and claimed in the co-pending application of Houshang Lolachi, Ser. No. 657,187, filed Feb. 11, 1976, and assigned to the present assignee. Basically, this centrifugation apparatus includes a rotor drive assembly 70 to which a rotor assembly 71 is journaled by means of a hollow support shaft 72. The rotor drive assembly 70 is journaled to a stationary hub assembly 73 by means of a vertical drive shaft 74. A freely rotating guide sleeve 75 is provided at the bottom end of drive shaft 74.

The centrifugal liquid processor unit 11 of the invention is seated on the rotor assembly 71. Fluid communication is established between the unit, which rotates with the rotor assembly 71, and the non-rotating portion of the flow system, which may be identical to that shown in FIG. 1 except for the omission of the rotating seal member 20, by means of a four channel umbilical cable 76 which extends from a central location along the axis of rotation of the separator unit downwardly through the center of drive shaft 72, radially outwardly through the guide sleeve 75, and upwardly to a fixed axially-aligned position established by a support arm 77. As described in the previously identified copending application Ser. No. 657,187, this routing of the umbilical cable 76, together with the rotor assembly 71 and rotor drive assembly 70 being driven in the same direction with a speed ratio of 2:1, establishes fluid communication with centrifugal separator unit 11 without the cable becoming twisted. Instead, the umbilical cable is subjected only to flexing, or repeated partial twists about its axis through angles not in excess of 180°, as the rotor assembly 71 rotates.

To obtain the desired 2:1 speed ratio between the rotor and rotor drive assembly two pairs of idler pulleys 78 are mounted on rotor drive assembly 70. A drive belt 79 is routed over these pulleys and around a stationary ring-type pulley 80 mounted on hub 73 at one end and around a rotor drive pulley 81 carried on the bottom end of the rotor drive shaft 72 at its other end. As the rotor drive assembly 70 is rotated clockwise by means of a motor (not shown) driving drive shaft 74, drive belt 79 establishes a clockwise rotation of rotor assembly 71. Assuming that stationary pulley 80 and rotor drive pulley 81 have the same diameter, the rotational speed of rotor assembly 71 will be exactly twice that of rotor drive assembly 70, by reason of the combined effect of the direct 1:1 drive relationship established by pulleys 80 and 81 and the planetary motion of idler pulleys 78 about the rotational axis or rotor drive assembly 71.

The tubing segments associated with inlet port 12 and collection ports 13, 14 and 15 communicate with respective ones of the passageways in umbilical cable 76, and communication with these passageways is in turn established with appropriate components of the blood processing system at the other end of the cable.

It is contemplated that the centrifugal separator unit 11 when intended for use in a seal-less centrifugation apparatus such as that shown in FIG. 7 would be manufactured as a single integral disposable unit in which umbilical cable 76 is included. To install this unit in the apparatus the free end of the umbilical cable would be threaded downwardly through the hollow rotor support shaft 72 and then radially outwardly and upwardly through sleeve 75 to support arm 77. The free end of the cable would then be pulled through and connected to the other components of the system. After use, the entire assembly would be removed from the apparatus and disposed of.

Thus, by forming the collection tubing segment 60 of a material which has the same density as that of the component to be derived, the free end of the tubing is automatically optimally positioned and the desired component is withdrawn through the tubing segment. This occurs because the tubing segment, one end of which is free-floating, seeks a radial position in the processing chamber which is iso-dense with all other components of the same density. By applying suction to the other end of the tube, elements of essentially the same density as the tubing are withdrawn. This has the advantage of allowing the tube to seek the optimum level without the assistance of mechanical, electronic or human forces.

In the case of blood fractionation, the tubing segments may be compounded to have a density of 1.065 to correspond to that of white blood cells. By selecting a different density, such as 1.068, other materials such as granulocytes can be withdrawn. In practice, the density of the tubing is preferably adjusted slightly to overcome corriolis and other forces within the separation chamber. For example, in collecting white blood cell components the tubing segments may have a density of 1.056 for optimum results.

The tubing segment of the white blood cell collection port may be formed of a blood-compatible silicone rubber material aerated during formation to an extent sufficient to obtain the desired specific gravity. In one successful application the density of the silicone tubing segment was reduced from 1.175 to 1.056 by aeration.

Two intervivos operations are possible with the apparatus of the invention, leukopheresis, the derivation of white blood cells, and platletpheresis, the derivation of plasma. In the case of leukopheresis, the tubing may be manufactured with a specific gravity of 1.056, which is slightly less than the 1.070 specific gravity of the white blood cell component to compensate for corriolis and other forces acting on the tubing segment. In the case of platletpheresis, the tubing segment may be manufactured with a specific gravity of 1.043, which is slightly less than the 1.050 specific gravity of the platelets.

The tubing segment typically extends approximately 90° around the circumference of the processing chamber, and typically two tubing segments are provided, although only one segment is shown in FIGS. 3 and 5 for the sake of clarity. The processing chamber may typically be formed with a radius of 13.5 centimeters and a channel width of 2 centimeters, and rotated at 2000 rpm.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A centrifugal processor for use in conjunction with centrifugation apparatus including rotatable drive means for separating a selected fractional component from a whole fluid, said separator comprising, in combination:

a housing carried on said rotatable drive means and defining a centrifugal processing separation chamber;

inlet means including an inlet port for supplying the whole fluid to be processed to said separation chamber, said selected fraction congregating within said chamber in a collection zone upon centrifugation of said chamber; and collection means including a free-floating collection port disposed within said chamber and floating within said separation zone during rotation of said chamber for removing said selected fraction therefrom.

2. A centrifugal separator as defined in claim 1 wherein said free-floating collection means comprise a port radially displacable with respect to the axis of rotation of said chamber and having a density substantially equal to that of said separated fraction.

3. A centrifugal separator as defined in claim 2 wherein said free-floating collection port comprises a tubing segment having an attached end and a free-floating end, and a density substantially equal to that of said selected fractional component to be separated.

4. A centrifugal separator as defined in claim 3 wherein said processing chamber is annular about its axis of rotation, and said tubing segment extends circumferentially along said chamber.

5. A centrifugal separator as defined in claim 4 wherein said tubing segment extends around approximately 90° of said chamber.

6. A centrifugal separator as defined in claim 4 wherein said attached end of said tubing is attached to a rigid tubing segment which extends in a circumferential direction at the attached end thereof and in a generally axial direction with respect to said housing at its other end.

7. A centrifugal separator as defined in claim 4 wherein said chamber includes a center portion of increased diameter, said collection zone is in said center portion, and said attached end of said tubing segment is generally aligned with said center portion.

8. A centrifugal separator as defined in claim 4 wherein said chamber includes a first additional collection port radially spaced from said free-floating collection port for removing from said chamber a second fraction of different density than said first fraction.

9. A centrifugal separator as defined in claim 8 wherein said second fraction is of lesser density than said first fraction and said additional collection port is disposed radially inwardly of said free-floating collection port, and wherein a third collection is provided in said chamber radially outwardly of said free-floating collection port for removing a third fraction of greater density than said first fraction.

10. A centrifugal separator as defined in claim 9 wherein said whole fluid is whole blood, said first fraction is the white blood cell component thereof, said second fraction is the plasma component thereof, and said third fraction is the red blood cell component thereof.

11. A centrifugal separator as defined in claim 1 wherein said centrifugal processing chamber is annular and extends about the axis of rotation of said rotary drive means.

12. A continuous-flow centrifugal blood separator for use in conjunction with centrifugation apparatus including a rotating drive member for separating RBC, WBC and plasma fractions from whole blood, said separator comprising, in combination:

a housing mounted for rotation with said drive member and defining an annular fluid processing chamber;

inlet means including an inlet port for supplying whole blood to be processed to said separation chamber;

outlet means including a tubing segment in said separation chamber having a free floating end and a density corresponding to said white blood cell component for removing said white blood cell component from said chamber; and additional outlet means including first and second additional ports within said chamber disposed radially outwardly and radially inwardly of said free floating end of said tubing segment for removing said red blood cell and plasma components, respectively.

* * * * *